United States Patent [19]

Kiyoshima

[11] 4,407,211

[45] Oct. 4, 1983

[54] CONVERTIBLE BED FOR OVEREDGE SEWING MACHINE

[75] Inventor: Hiroshi Kiyoshima, Utsunomiya, Japan

[73] Assignee: The Singer Company, Stamford, Conn.

[21] Appl. No.: 277,758

[22] Filed: Jun. 26, 1981

[30] Foreign Application Priority Data

Sep. 2, 1980 [JP] Japan ..... 55-124501[U]

[51] Int. Cl.[3] ..... D05B 73/10

[52] U.S. Cl. ..... 112/260

[58] Field of Search ..... 112/258, 260, 162

[56] References Cited

U.S. PATENT DOCUMENTS 3,344,762 10/1967 Szostak .
3,863,582 2/1975 Patricia .
4,343,252 8/1982 Hanyu ..... 112/258

FOREIGN PATENT DOCUMENTS 2726727 6/1978 Fed. Rep. of Germany ..... 112/260

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

An overedge sewing machine convertible from a flat bed to a cylinder bed version wherein the work supporting surface is supported by a vertical side wall and a vertical front wall with the cylinder bed protrusion projecting laterally from an extension to the vertical side wall. A needle bar reciprocates a needle into an opening in the extension of the vertical side wall and the work material is enabled to travel a path beneath the sewing needle by having a deep groove through the vertical side wall adjacent the cylinder bed protrusion behind the sewing needle, the extension being supported by a bridge connecting the vertical side wall, vertical front wall and extension. The deep groove behind the cylinder bed protrusion merges into a shallow groove beneath the cylinder bed protrusion where the material is able to undergo some deformation without effecting the stitching point. A work support plate pivoted on the vertical side wall is fashioned with a finger extending into the deep groove behind the cylinder bed extension so that in its upper position the work support plate forms a continuous work supporting surface with the cylinder bed protrusion and the work supporting surface of the bed. In its depressed position, the work support plate permits access to the groove encircling the cylinder bed protrusion by a cylinder of work material.

1 Claim, 5 Drawing Figures

Fig. 1
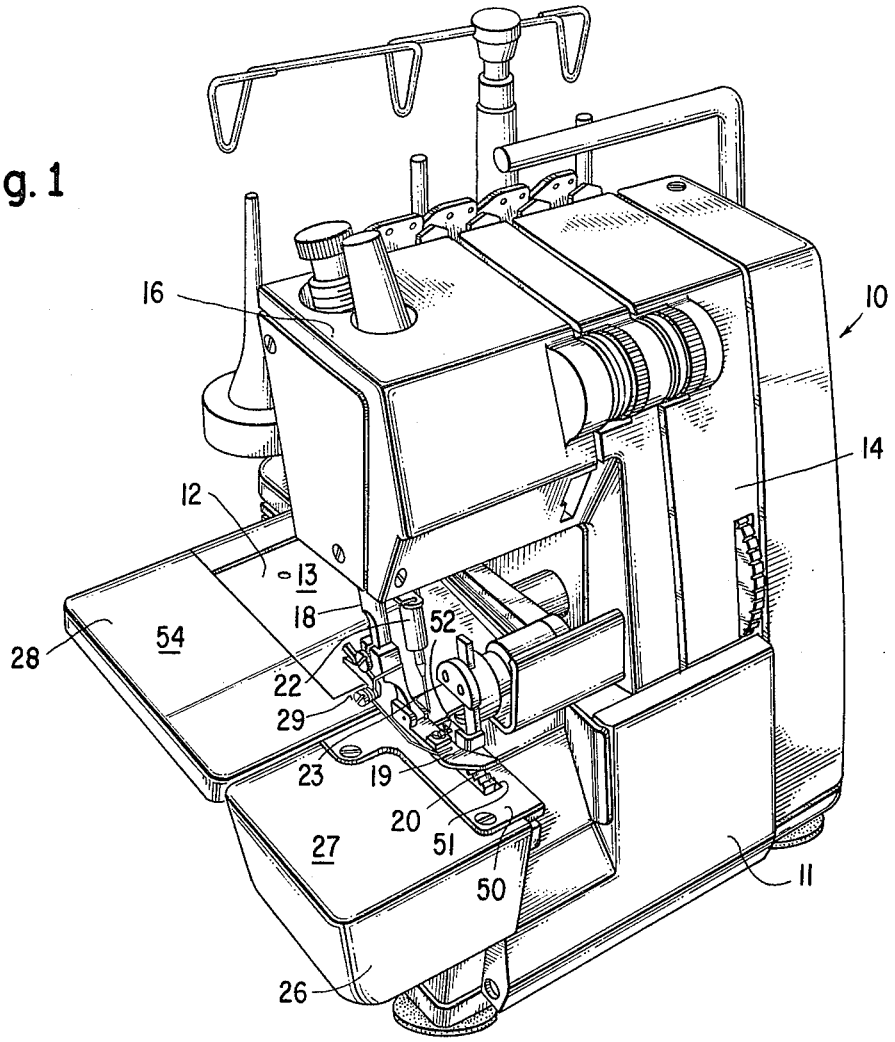
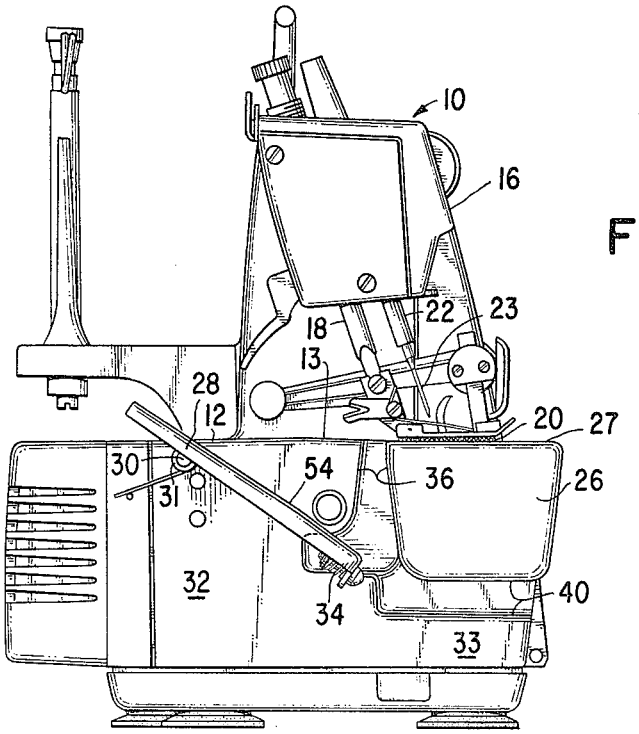
Fig. 2

CONVERTIBLE BED FOR OVEREDGE SEWING MACHINE

BACKGROUND OF THE INVENTION

This invention is in the field of sewing machines; more particularly, it is concerned with an overedge sewing machine having the usual flat work supporting bed which, however, may be converted to a cylinder bed in order to perform overedge stitching on a small cylinder of work material.

In prior art overedge sewing machines, the most common variety is the flat bed machine for stitching over the edge of a length of fabric. There are also overedge sewing machines in which the stitching is effected on a horn which may accommodate a sleeve. However, heretofore, a compact overedge sewing machine has not been available which would be able to handle lengths of fabric and, selectively, stitch on a sleeve or cuff.

What is required is an overedge sewing machine which in one compact machine would provide a flat bed support for a length of fabric being fed therethrough, and which, selectively, may be convertible to handle at will a sleeve or a cuff of a garment.

SUMMARY OF THE INVENTION

The above object is achieved in an overedge sewing machine having a work supporting bed supported by a vertical side surface extending parallel to the line of feed outwardly of and close by the sewing needle, with a vertical front surface extending laterally to the line of feed into the vertical side surface immediately behind the sewing needle. The vertical side surface includes an extension forwardly of the vertical front surface, the extension having a laterally projecting portion projecting from the extension on the opposite side thereof from the vertical front surface. The feed system of the sewing machine is formed with a feed bar having a feed dog carrying end thereof projecting through the vertical front surface into the projecting portion, which projecting portion also supports a throat plate through which the feed dog projects. The sewing machine supports an endwise reciprocating sewing needle which cooperates with sewing instrumentalities supported in or adjacent the laterally projecting portion. The vertical side wall is deeply grooved therethrough behind the projecting portion and the sewing needle, and a bridge is provided extending into the vertical front surface and connecting the vertical side surface on both sides of the groove for support thereof. The vertical side surface is formed about the bottom of the projecting portion with a more shallow groove to accommodate the insertion of a sleeve of work material about the projecting portion as deeply behind the sewing needle as possible with a minimum of distortion of the work material. The vertical side surface also supports a laterally extending pin, the pin pivotally supporting a plate having a finger extending into and filling the groove behind the sewing needle. Thus, as the plate is pivoted about the pin, the finger describes an arc in the deep groove exposing the deep groove and the more shallow groove so as to accommodate a sleeve with a minimum of distortion from a point behind the sewing needle to a point in front thereof.

BRIEF DESCRIPTION OF THE DRAWINGS

In the accompanying drawings a preferred embodiment of this invention is illustrated in which:

FIG. 1 is a front perspective view of an overedge sewing machine having this invention applied thereto;

FIG. 2 is an elevational view of the sewing machine from the side thereof with the cylinder bed exposed to show the details thereof;

Referring now to FIG. 1, which is a front perspective view of an overedge sewing machine 10, there is shown the frame of the sewing machine including the bed 12 from which rises the standard 14, the standard supporting a bracket arm 16. Supported within the bracket arm 16 there is a presser bar 18 terminating in a presser foot 19 for urging a work material into contact with the sewing machine feed dog 20 as is well known in the sewing machine art. Also the bracket arm 16 supports a needle bar 22, which needle bar terminates in a sewing machine 23 for cooperation with sewing instrumentalities (not shown) in the bed 12 of the sewing machine in the formation of stitches. The bed 12 includes as part thereof a cylinder bed protrusion 26 having an upper surface 27 on which is supported a throat plate 50 through which the needle 23 reciprocates and cooperates with other sewing instrumentalities in the formation of stitches. Located behind the cylinder bed protrusion 26 is a movable work support plate 28, which work support plate is formed with a finger 29 extending into the bed 12 behind the sewing needle 23 and presser foot 19. The work supporting surface 13 of the bed 12 is coplanar with the upper surface 27 of the cylinder bed protrusion 26 and with the top surface 54 of the movable work support plate 28.

Referring now to FIG. 2 there is shown a side elevation of the sewing machine 10 with the work support plate 28 moved into a position wherein the cylinder bed protrusion 26 is exposed to receive a circular object such as a sleeve. From FIG. 2 it is seen that the bed 12 is formed with a vertical side wall 32 extending in the direction of feed, from which vertical side wall extends a pivot pin 30, which pivot pin receives a pair of ears 31 fastened to the movable work support plate 28 so that the work support plate may pivot about the pin 30. A spring loaded catch 34 is carried on the forward surface of the work support plate 28 and cooperates with a cavity in the cylinder bed protrusion 26 when the work support plate is in the position shown in FIG. 1 to retain the work support plate in an elevated position. A slight force exerted against the forward surface of the work support plate 28 will cause the spring loaded catch 34 to release from the cavity in the cylinder bed protrusion 26 and the movable work support plate will move to the position shown in FIG. 2. A first groove 36 is provided in the vertical side wall 32 (see also FIG. 4), the groove being arcuate about the pivot pin 30 and arranged in a depth sufficient in the vertical side wall to accommodate the finger 29 (see FIG. 1) of the movable work support plate 28. A second groove 40 (see FIGS. 2 and 3) in an extension 33 to the vertical side wall 32 extends from the first groove 36 beneath the cylinder bed protrusion 26 to the front thereof.

Referring now to FIG. 3, there is shown a front view of the sewing machine 10 with a front cover 11 thereof folded down to show the interior of the sewing machine. In FIG. 3, the thickness of the extension 33 to the vertical side wall 32 is apparent and it can be seen that the second groove 40 extends approximately halfway through the extension. From the plan view of the sewing machine bed, FIG. 4, it can be seen that the first groove 36 is a deep groove which extends through the thickness of the vertical side wall 32, in other words, deeper than the second groove 40. A vertical front wall 42 is apparent in FIG. 3, 4 and 5 and extends to the vertical side wall 32 at the location of the first groove 36. Thus, it is apparent that the cylinder bed protrusion 26 itself extends from the extension 33 of the vertical side wall 32 forwardly of the vertical front wall 42. By reference to FIGS. 4 and 5 it is apparent that the extension 33 to the vertical side wall 32 derives support from the vertical side wall and the front wall 42 by means of a bridge 44 which extends about the groove 36 and forms the back wall thereof and connects the vertical side wall with the vertical front wall 42 and the vertical side wall extension 33. By reference to FIGS. 3 and 5, a feed bar 46 is seen to extend through an opening 43 in the vertical front wall 42 to have the feed dog supporting end 47 thereof extend into an opening 35 in the extension 33, into the cylinder bed protrusion 26, with the feed dog 20 extending through the slots 51 in the throat plate 50. The throat plate 50 spans the opening 35 in the extension 33, and the sewing needle 23 and feed dog 20 operate in this opening. The first groove 36, by extending through the vertical side wall 32, and thereby deeper than the extension 33, extends into the work supporting surface 13 of the bed 12 and provides a channel for work material inwardly of and behind the sewing needle 23.

Figure 3:
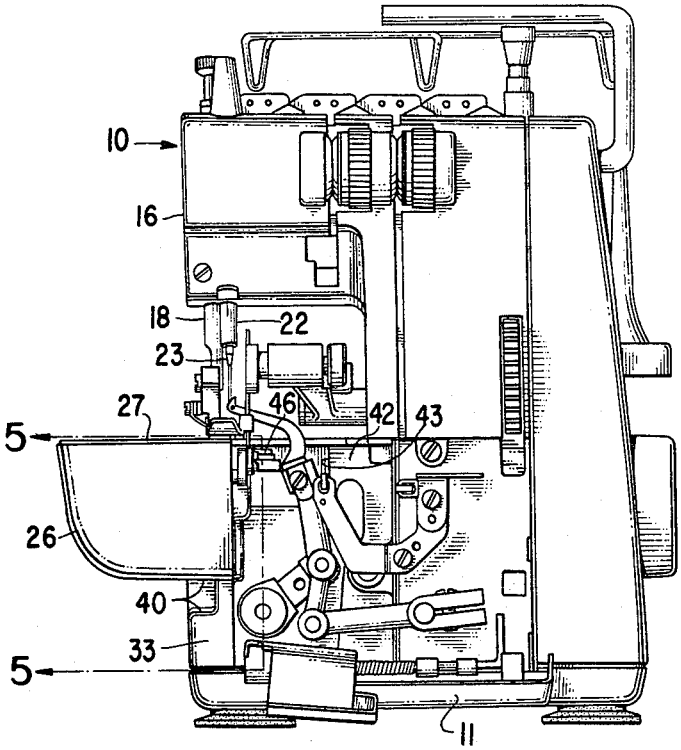
FIG. 3 is an elevational view of the sewing machine from the front thereof with a portion thereof swung away to expose the inner workings of the sewing machine.
Figure 5:
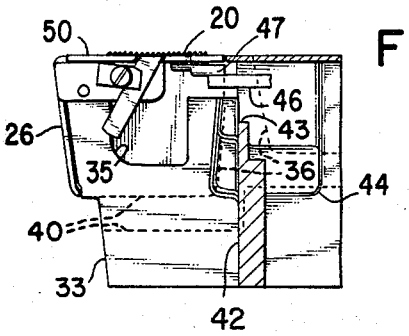
Figure 4:
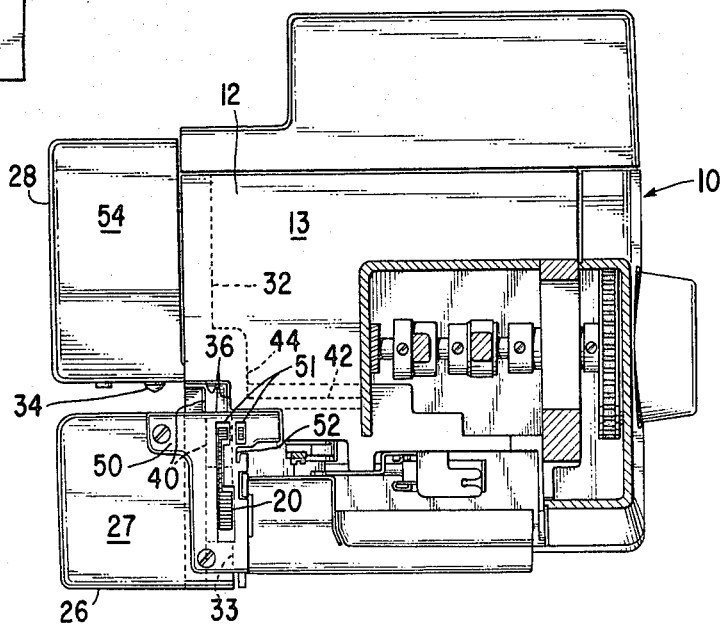
FIG. 4 is a plan view of the sewing machine partially in section showing the bed thereof and the relationship of portions of the bed with the sewing needle; and, FIG. 5 is a sectional view taken substantially along the line 5—5 of FIG. 3 to show details of the extension to the vertical side wall.

Thus, there is provided in compact form, a sewing machine 10 in which a work support plate 28 may be swung away from a cylinder bed protrusion 26 to permit a cylinder of work material to extend around the cylinder bed protrusion to a point beyond the sewing needle 23 immediately behind the sewing needle, with the work material deflected away from this position beneath the cylinder bed protrusion but being capable of a movement well beneath the sewing needle when coming up from the second groove 40 to a position in front of the sewing needle. This arrangement permits the advantages of a full work supporting surface for an overedge sewing machine when stitching long lengths of material, yet it will permit the conversion to a cylinder bed version when operating on a small circular piece of work material.

I claim:

1. An overedge sewing machine comprising a frame, said frame including a bed (12) having a work supporting surface (13), said work supporting surface (13) supported in part by a vertical side wall (32) and an adjacent vertical front wall (42), said bed (12) further including an extension (33) to said vertical side wall (32) and a portion (26) projecting laterally from said extension (33) beyond said sewing machine on the opposite side of said extension (33) from said vertical front wall (42), said projecting portion (26) forming with said extension (33) an upper surface (27) coplanar with said work supporting surface (13) of said bed, said upper surface (26) having slots (51) therethrough in the direction of said vertical side wall (32), said projecting portion (26) having a cross section for accommodation in a cylinder of work material, said frame supporting sewing instrumentalities including a sewing needle (23) movable into an opening (35) in said extension (33) for cooperation with other of said sewing intrumentalities in the formation of stitches, said bed supporting a work feeding system for feeding a work material in a line of feed relatively to said sewing instrumentalities and substantially parallel to said vertical side wall (32), said feeding system including a feed bar (46) supported in said bed and having an end (47) thereof jutting from said bed to said opening (35) in said extension (33) to said vertical side wall (32), a feed dog (20) supported on the end of said feed bar (46), said feed dog (20) extending into said slots (51) in said upper surface (27), a first and second groove (36, 40) in said vertical side wall (32) and in said extension (33) about said laterally projecting portion, said first groove (36) extending through said vertical side wall (32) behind said sewing needle (23), a bridge (44) extending from said vertical side wall (32) around said first groove (36) to said extension (33) of said vertical side wall (32), said bridge (44) forming one wall of said first groove (36), a pivot pin (30) extending from said vertical side wall (32) of said bed adjacent the work supporting surface (13) thereof, a work support plate (28) with a top surface (54) having an edge adjacent said vertical side wall (32), said top surface (54) including a finger (29) adapted to fit into said first groove (36) behind said sewing needle (23), said work support plate (28) pivotable on said pivot pin (30) from a first position with said top surface (54) coplanar with said work supporting surface (13) of said bed (12) and said upper surface (27) of said projecting portion (26) to a second position with said top surface (54) and said finger (29) separated from said upper surface (27) and with said grooves (36, 40) about said laterally projecting portion (26) exposed to accommodate an edge of a cylinder of work material.

* * * * *